United States Patent [19]

Gidwani

[11] Patent Number: 4,993,989

[45] Date of Patent: Feb. 19, 1991

[54] FOLDING DEVICE FOR USE AS A GAME, PUZZLE, BOOK OR TOY

[76] Inventor: Joan Gidwani, 83 Thomas St., Dedham, Mass. 02026

[21] Appl. No.: 427,645

[22] Filed: Oct. 26, 1989

[51] Int. Cl.[5] ..... A63H 33/00; A63H 33/38; A63F 9/08; E04B 1/32

[52] U.S. Cl. ..... 446/487; 446/148; 52/81; 52/DIG. 10; 273/155

[58] Field of Search ..... 52/81, DIG. 10; 446/487, 488, 148, 149; 273/155, 153 R, 153 S, 157 R, 159, 205

[56] References Cited

U.S. PATENT DOCUMENTS

| | | | |
|---|---|---|---|
| D. 248,987 | 8/1978 | Paschal | 273/155 X |
| 2,922,239 | 1/1960 | Glynn, Jr. | 446/488 X |
| 3,302,321 | 2/1967 | Walker | 273/155 U X |
| 3,662,486 | 5/1972 | Freedman | 273/155 X |
| 3,746,345 | 7/1973 | Palazzolo | 52/DIG. 10 X |
| 3,811,682 | 5/1974 | Neale et al. | 446/488 X |
| 3,962,816 | 6/1976 | Sarid | 446/488 |
| 3,971,156 | 2/1976 | Lamlee | 446/488 |
| 4,227,334 | 10/1980 | Hooker | 52/81 X |
| 4,327,516 | 5/1982 | Lubozynski | 446/488 |
| 4,359,842 | 11/1982 | Hooker | 52/DIG. 10 X |
| 4,735,418 | 4/1988 | Engel | 273/155 |

FOREIGN PATENT DOCUMENTS

| | | | |
|---|---|---|---|
| 100761 | 8/1925 | Czechoslovakia | 446/487 |
| 125593 | 7/1949 | Switzerland | 446/487 |
| 1208694 | 10/1970 | United Kingdom | 446/487 |

*Primary Examiner*—Robert A. Hafer
*Assistant Examiner*—D. Neal Muir
*Attorney, Agent, or Firm*—Wolf, Greenfield & Sacks

[57] ABSTRACT

A folding device for use as a toy, puzzle, game and the like is formed by a series of like components. Each component comprises a pair of mirror-image segments, hinged together along a common edge and essentially forming a truncated triangle. A series of these truncated triangles are hinged together in a series to permit the unit to be folded in a variety of arrangements.

16 Claims, 3 Drawing Sheets

FOLDING DEVICE FOR USE AS A GAME, PUZZLE, BOOK OR TOY

BACKGROUND OF THE INVENTION

Many folding devices have been developed into a variety of games, puzzles, toys and the like. In general, these devices include a plurality of flat, polygonal panels hinged together along common edges to permit accordian like folding of the panels into a variety of shapes and configurations in both flat and three-dimensional form. Included among these are those illustrated in various U.S. letters Pat Nos., including Stalker, 1,997,022 issued Apr. 9, 1935; Hopkins, 2,992,829 issued July 18, 1961; Behr, 3,518,785 issued July 1, 1968; Neale, 3,811,682 issued May 21, 1974; Lamlee, 3,971,156 issued July 27, 1976; Brinkley, D246,544 issued Nov. 29, 1977; Lamlee, 4,240,858 issued Dec. 23, 1980; Busse, 4,366,961 issued Jan. 4, 1983; and Engel, 4,735,418 issued Apr. 5, 1988.

Most of these prior art Pat Nos. comprise combinations of hinged-together, equilateral or isosceles triangles. Such combinations, including the Behr Pat. No. 3,518,785; the Neale Pat. No. 3,811,682; the Brinkley Pat. No. D246,544; the Hopkins Pat. No. 2,992,829; the Busse Pat. No. 4,366,961: and the Stalker Pat. No. 1,997,022 are arranged with hinge lines connecting individual triangular panels. However, at least some of these triangles are interconnected on three sides to adjacent triangular panels. Some of these are designed primarily to create three-dimensional forms including, for example, Busse 4,366,961 which is primarily designed for constructing a pyramid, or Lamlee 3,971,156 and 4,240,858 and Engel 4,735,418, which are designed to form hexa-flexagons, or Hopkins, which also discloses a means for creating polymorphic geometrical devices. In some of these devices, such as Enqel and Lamlee, equilateral triangles are initially secured along two edges as an intermediate step.

Because of the selection of the geometric shapes involved and because of the specific design considerations involved in each of these known prior art devices, such puzzles have limited utility. The arrangements into which these polygonal shapes may be arranged do not lend themselves to selective use as books, games, puzzles and displays which have the inherent appeal of applicant's invention.

SUMMARY OF INVENTION

The present invention comprises a plurality of flat, polygonal components hinged together in a series along adjacent edges and preferably forming a continuous loop. These components comprise symmetrically-arranged segments that may be folded and arranged to define a wide range of puzzles, toys, books or games. When used as a puzzle or display, a wide range of arrangements is possible.

In one form, the present invention may be used as a book. An identical array may be used as a puzzle or decorative element. A number of three dimensional forms may be created by rearranging the various components.

A further object of the present invention is to provide a plurality of components arranged in a series of similar panels that may be folded from one form to another and may be formed in a relatively flat compact configuration.

A further object of the present invention is to provide segments hinged together to form selective arrangements of designs for a puzzle.

A further object of the present invention is to provide an improved array of flat panels that are hinged together in a manner that permits use and storage of the component without likelihood of damage or destruction. A further object of the present invention is to provide an improved display or puzzle, capable of being easily made, stored and shipped, and capable of being merchandised in a variety of forms.

DESCRIPTION OF DRAWING

The foregoing objects and advantages of the present invention will be more clearly understood when considered in conjunction with the accompanying drawings in which.

DETAILED DESCRIPTION OF INVENTION

Figure 1:
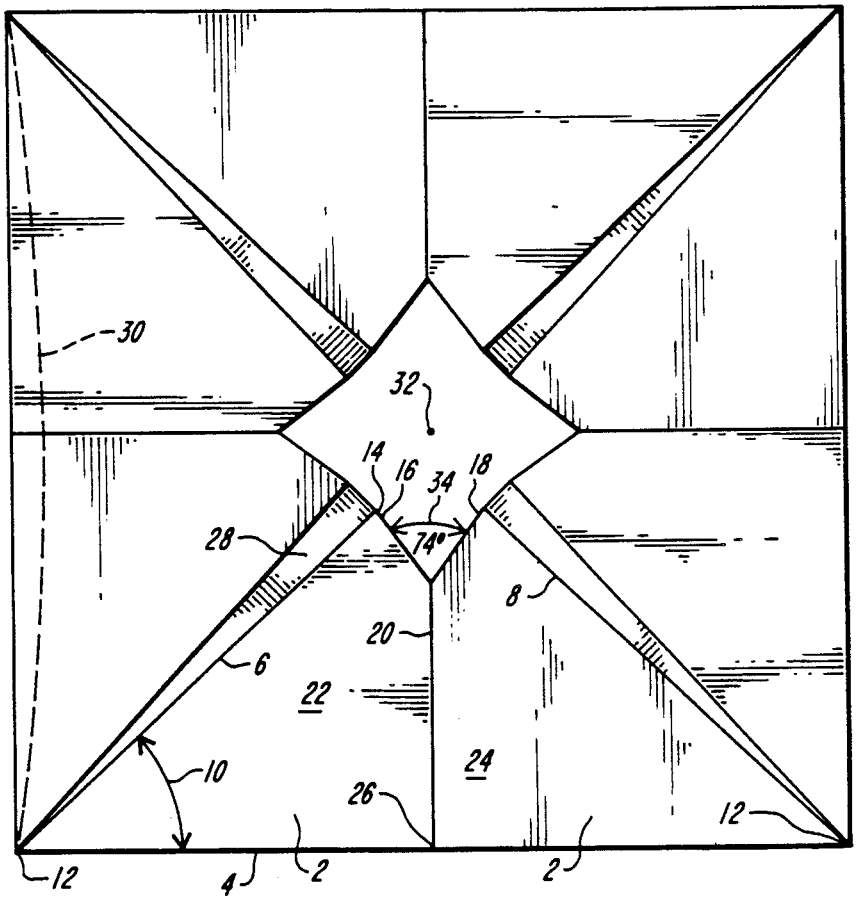
FIG. 1 is a plan of view of a preferred embodiment of the invention, with the various components thereof open and lying flat.

The embodiment illustrated in the drawings is designed primarily as a toy or puzzle. However, with appropriate changes to the surface indicia of the various components, the invention may also be used for other purposes. For example, by printing text or pictures on the surfaces of the components, the device may be used as a game, book, brochure, advertising element, or the like. The components also may be formed with indicia in the form of symbols or designs printed on the surface, of the components or alternately, with holes formed in various combinations or shapes in the components. When used as a game, the holes may be so formed as to require various degrees of mental skill or dexterity for appropriate alignment of holes in a series of juxtaposed panels to solve a particular problem or achieve a game goal.

Also contemplated in this invention is the use of an embodiment for a game in which the components are either transparent, in whole or in part, to permit an overlapping arrangement of panels into various visual images. Other exemplary uses of this invention are described further in connection with specific figures illustrating the invention.

The preferred embodiment of this invention comprises a plurality of like polygonal components 2, secured together as hereinafter described. These polygonal components 2 are defined by a base edge 4, having side edges 6 and 8 extending at an angle 10 from the end 12 of the base edge 4. The ends 14 remote from the ends 12 of the side edges 6 and 8 and are interconnected by a pair of additional side segments 16 and 18. The component 2 is symmetrically bifurcated by a hinge line 20 that is equidistant at its end adjacent base line 4 from the opposite ends 12 of the base line 4. The hinge line 20 bifurcates the component 2 into symmetrically arranged, mirror image segments 22 and 24. The hinge line 20 which intersects base 4 at corner 26, forms orthogonality-related sides of the individual segments 22 and 24.

The angle 10 at each end 12 should not be greater than 45° or less than approximately 30°, and preferably, is not less than 36°. In the preferred embodiment illustrated, the angle 10 is 43°. When the angle 10 is less than 45°, a gusset or web hinge 28 is integrally secured to the side edge 6, of the component and flexibly connects it to the side edge 6 of the next adjacent component 2.

The gusset 28 is made of a flexible material, preferably fabric or plastic, whereas, the component 2 is preferably made of a relatively rigid material, such as cardboard, hard plastic or wood. The gusset or web hinge 28 may be suitably secured at its edges to the adjacent side edges 6 by cement, thermoplastic means or any other conventional means.

While the base edge 4 is described and illustrated in the preferred embodiment as a straight edge, it may, for a variety of purposes, be curved or otherwise non-straight as is exemplified by dotted line 30. The dotted line 30 may take a variety of forms, including for example, saw-toothed, scalloped or irregular. In such an arrangement, the angle 10 at the ends 12 may be measured from an imaginary line drawn between the ends 12 of base edge 4.

The corners defining angles 10 are all equidistant from a center point 32 which is defined when various components are arrayed in flat form, as illustrated in FIG. 1. In this arrangement, four stacks of components essentially form a square with center point 32 central to the array.

The side segments 16 and 18 intersect at angle 34. The side segments 16 and 18 are equal in length and define an angle 34, which can vary in size. The angle 34 may be greater or less than 90°, but preferably is 74°. If the angle is significantly greater than 90°, the unit becomes less stable and is more likely to collapse during use.

When angle 10 is less than 45°, the space between side edges 6 of adjacent components 2 is accommodated by a flexible hinge 28, as previously described. Such a hinge 28 facilitates a flexing and folding of one component on the other. If, however, angle 10 is 45°, the use of flexible hinges will preclude the arrangement from lying flat, as illustrated in FIG. 1 In some instances, such an arrangement may be desired in order to achieve an array in which at least some of the components will not lie flat, and may have an appearance of popping up.

The components 2 may be made from a wide range of material, such as paper, cardboard, wood or plastic. The thickness of the components may vary, but in general, are preferably, relatively thin with a thickness, in general, not exceeding an eighth of an inch (⅛"). The gusset or web hinge 28 may be made of conventional fabric material adapted to be secured at its edge to form a flexible Binge.

Figure 2:
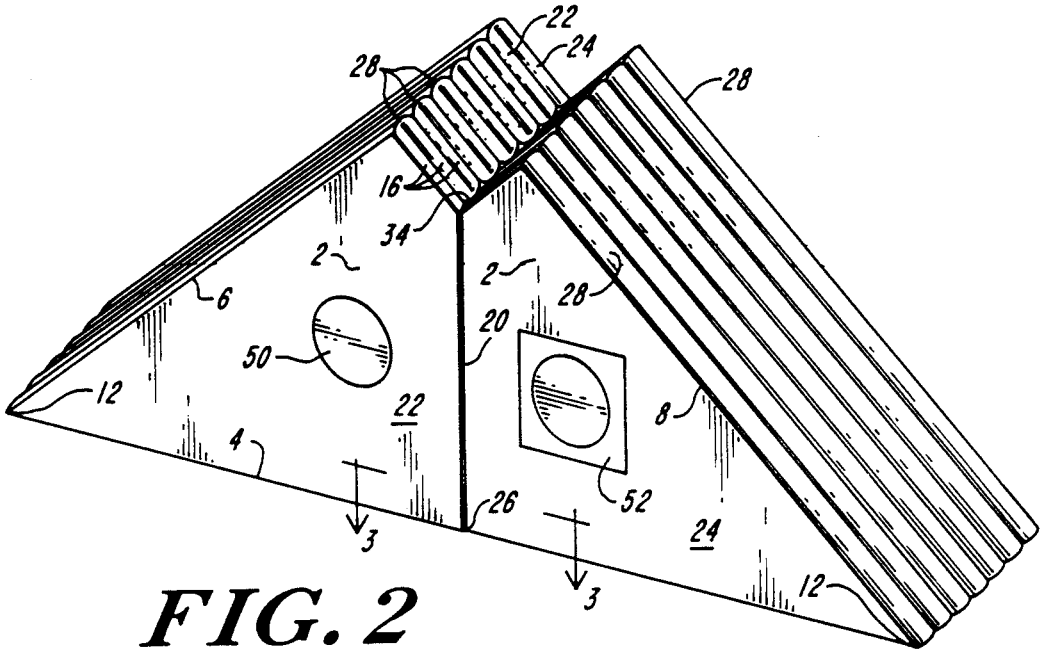
FIG. 2 is a perspective view of the embodiment of FIG. 1, in a closed or completely folded arrangement.
Figure 3:
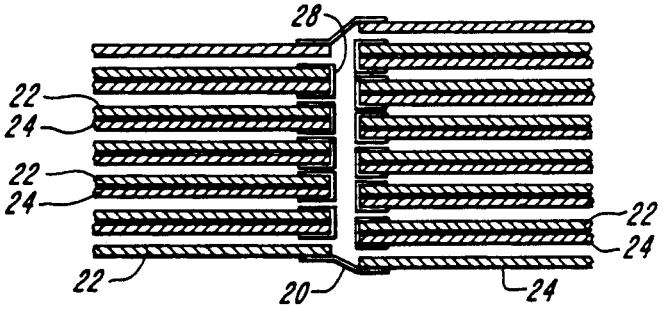
FIG. 3 is a cross-sectional detail, taken substantially along line 3—3 of FIG. 2.

In the preferred embodiment, the numbers of panels may vary. A minimum number of panels is four, but for preferred usage in most instances, the device should comprise at least twelve panels. While at least twelve components may be used, a great deal more provide a variety of interesting arrays. As illustrated in FIGS. 2 and 3, the preferred embodiment has 13 components or a total of 26 segments.

FIGS. 2 and 3 illustrate the preferred embodiment with all components lying in a flat, parallel, folded array. This stack of components 2, with segments 22 and 24 of each parallel with one another may be folded and arranged in a variety of shapes for game, puzzle, design or other purpose. In such an array, the surface treatment of each segment 22 and 24 will, of course, vary. In FIG. 2, a circle 50 on one segment 22 and a circle in a square 52 on segment 24 represent various possible design configurations. The symbols may be replaced with text, pictures or the like. The opposite sides of the segments may be treated in a like fashion with similar or different symbols. In one embodiment, one surface of the segments is formed with a background color different from the background color on the opposite side. These various designs may be used in a variety of arrays as illustrated in FIGS. 4 to 9.

Figure 4:
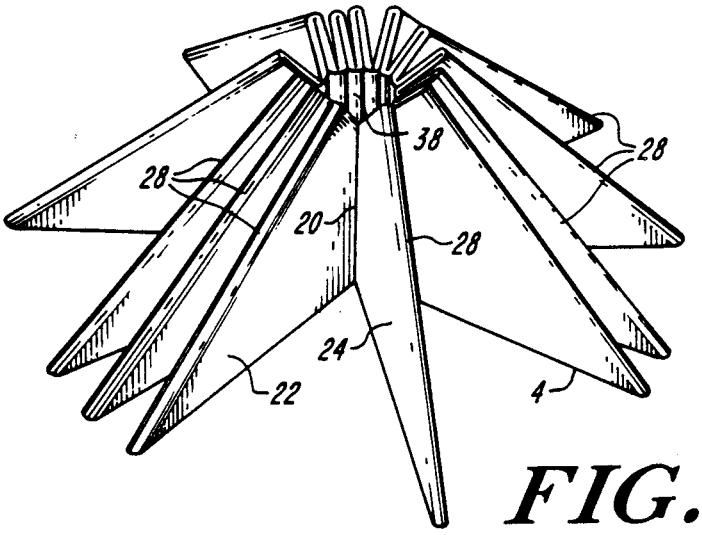
FIG. 4 is a perspective view of the preferred embodiment, illustrating the components arrayed in a book leaf configuration.

In the array illustrated in FIG. 4, 13 components having a total of 26 segments are illustrated with all of the components secured end-to-end by flexible gussets or web hinges 28, at the side edges 6. By virtue of these hinges 28 and the hinge lines 20 between adjacent segments, the array of components may assume a variety of forms or configurations. In FIG. 4, adjacent segments 22 and 24 comprising a component partially folded towards one another along hinge line 20. In this array, the hinge line 20 of each component is arrayed parallel to the hinged lines 20 of the others to form substantially a cylindrical array 38 of hinge lines, centrally located in the array. As illustrated, with the base edge 4 resting on a surface, the segments adjacent to one another on either side of a gusset or web hinge 28 may be pivoted about the lines 20. The segments extending from the cylindrical array 38 of hinge lines 20 function similarly to page leaves that pivot about a book spine. Accordingly, the arrangement of FIG. 4 may be used in book-like fashion when appropriately covered with indicia, such as text. For example, the segments may have printed on them pictures of animals with some descriptive materials. Alternate embodiments, using different surface indicia, are obviously possible.

Figure 5:
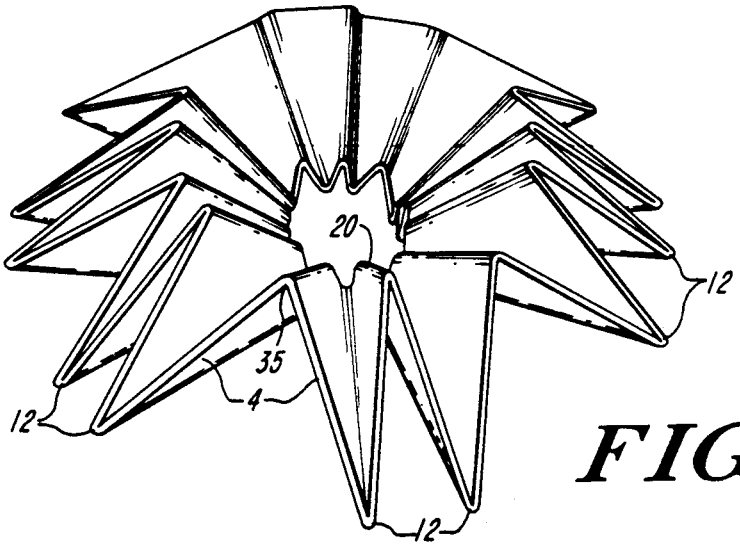
FIG. 5 is a perspective view of the invention, showing the components in a position inverted from that of FIG. 4.

In FIG. 5, the position of the array of FIG. 4 is inverted so that the reverse sides of the segments 22 and 24 of those illustrated in FIG. 4 are illustrated. In this position, each of ends 12 touches a flat surface with adjacent ends 12 defining an angle 35, above the surface. The hinge lines 20 are radially arranged and extend upwardly at an acute angle to the supporting surface upon which the unit rests. This array may be used as a decorative display or for game purposes. In the particular arrangement of FIG. 6, the array is supported on the ends 12 only of each component. In this arrangement, the base edge 4 extends at an acute angle upwardly from a supporting surface with the hinge line 20 extending upwardly and inwardly. The side segments 16 and 18 are uppermost and form the top of the unit.

Figure 7:
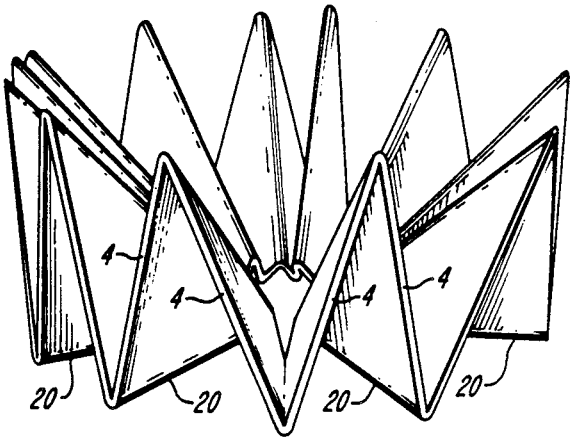
FIG. 7 is a view also inverted from that of FIG. 4, but with a different degree of rotation.

In the position of FIG. 7, the hinge lines 20 are all lowermost and rest on a common surface. In this position, the base edge 4 of each component projects normally upwardly from the supporting surface.

Figure 6:
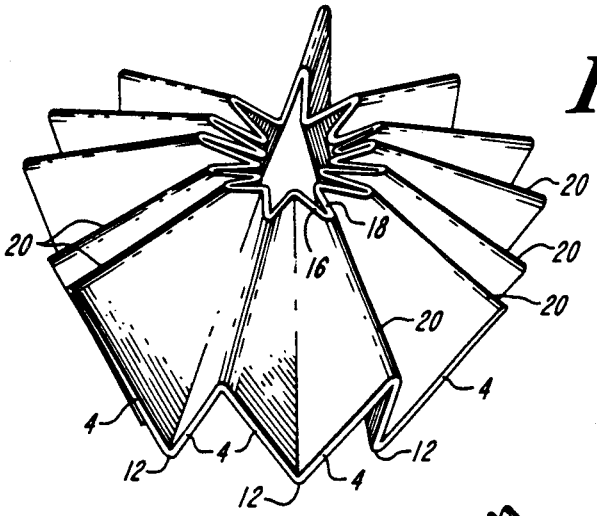
FIG. 6 is a view of the components inverted from the view of FIG. 4, but with the center portion upwardly tilted from the view of FIG. 5.
Figure 8:
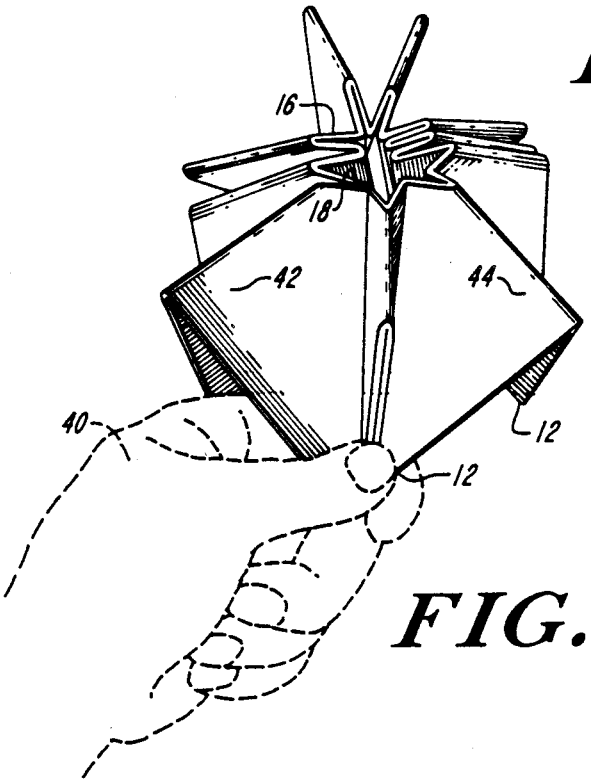
FIGS. 8 and 9 illustrate an arrangement of the device in which non-adjacent components may be arrayed in juxtaposition to one another for side by-side comparison.

FIG. 8 illustrates a position somewhat modified from that of FIG. 6. In FIG. 8, as in FIG. 6, the side segments 16 and 18 are uppermost in the array. However, in this position, the ends 12 of the components are gathered together, rather than spread apart to form a supporting base, as illustrated in FIG. 6. In this position, the gathered together ends 12 may be grasped in one hand 40 and individual segments 42 and 44 may be compared side by side, even though specific segments 42 and 44 are not adjacent to one another and do not form a common component. Thus, various components may be folded or unfolded to permit positioning adjacent to one another of segments or panels that otherwise are remote from one another. This arrangement permits a variety of uses. For example, the segments may be printed with questions and answers that comprise match or no-match puzzles for adjacent comparisons with one another by folding and unfolding a series of components to move remote components closer together.

Figure 9:
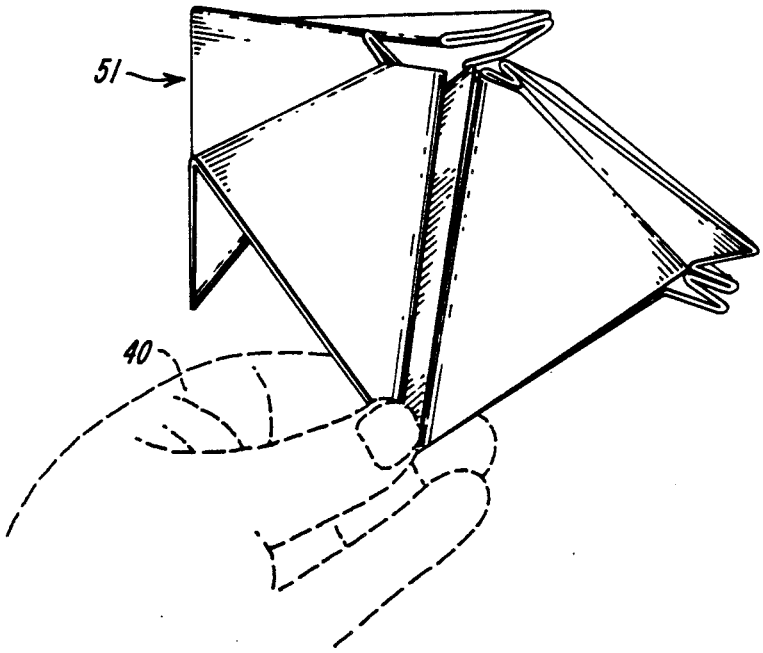

FIG. 9 further illustrates the usage of FIG. 8. In this arrangement, however, several of the components have been moved to fully-unrelated locations, as illustrated at 51.

While the preferred embodiment contemplates an arrangement in which a plurality of components are secured end-to-end to form a continuous unit about an open center, further, alternate embodiments contemplate the use of a series of hinged together components with the hinges formed in a series as distinguished from a endless loop.

What is claimed is:

1. A folding device for use as a toy, puzzle, and game, comprising a plurality of like polygonal components with each component having a pair of symmetrically arranged, mirror-imaqe segments interconnected along a common hinge, said segments each having first and second orthogonally-related sides forming one corner, with said one side defining said hinge, a third side extending at an acute angle from said second side and at least one additional side connecting said third and first sides, and hinge means interconnecting each of said polygonal components to adjacent polygonal components along adjacent third sides.

2. A device as set forth in claim 1 wherein said at least one additional side comprises a single side.

3. A device as set forth in claim 1 wherein said first and second sides are from said third side at equal angles.

4. A device as set forth in claim 3 having at least four components.

5. A device as set forth in claim 4 having thirteen components.

6. A folding device for use as a toy, puzzle, and game comprising a plurality of like polygonal components, with each component formed of a polygonal shape, having a base edge and a pair of side edges extending equiangularly from opposite ends of said base with the ends remote from said base interconnected by at least one additional edge, means forming a hinge extending normally from said base, equidistant from said ends of said base, said components connected to adjacent components along adjacent side edges, and means, forming hinges at said side edges.

7. A folding device for use as a toy, game, puzzle, and display, comprising a plurality of components hinges successively together along adjacent side edges, said components each having a base edge, a pair of said side edges extending at an acute angle from each end of said base edge and, at least one additional edge connecting each of the other ends of said side edges, wherein said components are each formed with a hinge line extending orthogonally from said base edge to said additional edge to divide said component into mirror-image segments.

8. A device set forth in claim 7 wherein said components are hingedly connected together into an endless loop.

9. A device as set forth in claim 8 wherein said acute angle is less than 45°.

10. A device as set forth in claim 9 having a web hinge hinging said components together at adjacent side edges.

11. A device as set forth in claim 8 wherein said acute angle is between 30° and 45°.

12. A device as set forth in claim 8 wherein said angle is substantially 43°.

13. A folding device for use as a toy, game, puzzle, display, comprising a plurality of components hinged together along common edges, said components each having a base edge, a pair of edges extending at an acute angle from each end of said base edge and, at least one additional edge connecting each of the other ends of said side edges, wherein the other ends of said side edges are interconnected by a pair of additional intersecting edges extending angularly to one another.

14. A device as set forth in claim 13 wherein said components are each formed with a hinge line extending orthogonally from said base edge to said intersection of said additional edges.

15. A device as set forth in claim 14 wherein the angle of said intersecting additional edges is substantially 74°.

16. A device as set forth in claim 15 wherein the angle of said intersecting additional edge is not greater than substantially 90°.

* * * * *